US010954841B2

(12) United States Patent
Brinkmeyer

(10) Patent No.: US 10,954,841 B2
(45) Date of Patent: Mar. 23, 2021

(54) DIESEL EXHAUST FLUID MIXING

(71) Applicant: Caterpillar Inc., Peoria, IL (US)

(72) Inventor: Scott David Brinkmeyer, Delavan, IL (US)

(73) Assignee: Caterpillar Inc., Peoria, IL (US)

( * ) Notice: Subject to any disclaimer, the term of this patent is extended or adjusted under 35 U.S.C. 154(b) by 354 days.

(21) Appl. No.: 15/725,458

(22) Filed: Oct. 5, 2017

(65) Prior Publication Data

US 2019/0107025 A1 Apr. 11, 2019

(51) Int. Cl.

| | |
|---|---|
| ***F01N 3/28*** | (2006.01) |
| ***B01F 5/06*** | (2006.01) |
| ***B01F 3/04*** | (2006.01) |
| ***F01N 3/20*** | (2006.01) |
| ***F01N 3/021*** | (2006.01) |
| ***F01N 3/10*** | (2006.01) |
| ***F01N 13/00*** | (2010.01) |

(52) U.S. Cl.

CPC ..... *F01N 3/2892* (2013.01); *B01F 3/04049* (2013.01); *B01F 5/0659* (2013.01); *F01N 3/021* (2013.01); *F01N 3/103* (2013.01); *F01N 3/106* (2013.01); *F01N 3/2066* (2013.01); *F01N 13/0097* (2014.06); *F01N 2240/20* (2013.01); *F01N 2470/08* (2013.01); *F01N 2470/14* (2013.01); *F01N 2470/18* (2013.01); *F01N 2470/22* (2013.01); *F01N 2470/24* (2013.01); *F01N 2610/02* (2013.01)

(58) Field of Classification Search

CPC combination set(s) only.
See application file for complete search history.

(56) References Cited

U.S. PATENT DOCUMENTS

| | | | | |
|---|---|---|---|---|
| 6,312,650 | B1 | 11/2001 | Frederiksen et al. | |
| 6,444,177 | B1 | 9/2002 | Muller et al. | |
| 6,601,385 | B2 * | 8/2003 | Verdegan | B01D 53/8631 60/274 |
| 7,614,215 | B2 * | 11/2009 | Warner | F01N 13/0097 60/286 |
| 7,856,807 | B2 * | 12/2010 | Gibson | B01F 5/0603 60/274 |
| 8,230,678 | B2 | 7/2012 | Aneja et al. | |
| 8,938,945 | B2 * | 1/2015 | Hylands | B01D 53/90 60/273 |
| 9,322,309 | B2 | 4/2016 | Beyer et al. | |

(Continued)

FOREIGN PATENT DOCUMENTS

| | | |
|---|---|---|
| DE | 102009036511 | 7/2009 |
| WO | 0009869 | 2/2000 |

(Continued)

*Primary Examiner* — Binh Q Tran

(74) *Attorney, Agent, or Firm* — Law Office of Kurt J. Fugman LLC

(57) ABSTRACT

A canister assembly for use in an exhaust gas aftertreatment device comprises a cylindrical shell defining a cylindrical axis, a radial direction, and a circumferential direction, a top end and a bottom end. A flow tube is inserted into the top end of the cylindrical shell and terminates short of the bottom end of the cylindrical shell, defining an exit of the flow tube. A mixing bowl member including a symmetrical annular shape about the cylindrical axis and defining a mixing bowl pocket is attached at the bottom end of the cylindrical shell.

20 Claims, 3 Drawing Sheets

(56) References Cited

U.S. PATENT DOCUMENTS

| | | | | |
|---|---|---|---|---|
| 9,371,764 | B2 | 6/2016 | Moran et al. | |
| 9,551,266 | B2 * | 1/2017 | Melecosky | B01D 53/9477 |
| 2002/0073697 | A1 | 6/2002 | Jankowski | |
| 2006/0008397 | A1 * | 1/2006 | Bruck | F01N 3/2821<br>422/180 |
| 2008/0041036 | A1 * | 2/2008 | Witte-Merl | F01N 3/2066<br>60/282 |
| 2008/0264048 | A1 * | 10/2008 | Nishiyama | B01D 53/944<br>60/299 |
| 2011/0308234 | A1 | 12/2011 | De Rudder | |
| 2014/0026540 | A1 | 1/2014 | Beyer et al. | |
| 2016/0184783 | A1 * | 6/2016 | Tyni | B01F 5/0065<br>422/169 |

FOREIGN PATENT DOCUMENTS

| | | |
|---|---|---|
| WO | 2014098729 | 6/2014 |
| WO | 2016044086 | 3/2016 |

* cited by examiner

DIESEL EXHAUST FLUID MIXING

TECHNICAL FIELD

The present disclosure relates generally to canister assemblies used to treat exhaust fluid to reduce harmful emissions. More specifically, the present disclosure relates to a canister assembly that uses a mixing bowl member at the bottom of the canister assembly to reduce the size and complexity of the aftertreatment apparatus for reducing harmful emissions.

BACKGROUND

Internal combustion engines are routinely used in various industries to power machines and equipment. Examples of industries using such machines and equipment include marine, earth moving, construction, mining, locomotive and agriculture industries, etc. In certain markets and market segments, gasoline or diesel fuel powered engines are used. These engines often emit undesirable emissions such as particulate matter and NOx. Aftertreatment devices such as canister (CAN) assemblies that employ various technologies to reduce these emissions are also well known in the art. However, these known aftertreatment devices suffer from various deficiencies.

First, many of the prior aftertreatment devices are complex including many components such as flappers and fins that are disposed in the inlet flow tube of a CAN assembly to promote the mixing of an exhaust treatment fluid, such as DEF (diesel exhaust fluid), into a stream of exhaust gas so that the emissions are effectively reduced. If the mixing of the DEF into the exhaust gas stream is not sufficient, the desired reduction in emissions may not be achieved and/or the DEF may condense and crystalize on various parts of the CAN assembly. This may require the CAN assembly to be cleaned or to have other maintenance performed on the CAN assembly. This can be costly and time consuming. So, the need for effective mixing of DEF with exhaust gases is needed.

Second, the use of such flappers and fins may be costly to manufacture. When cost is of considerable concern, using complex features such as flappers and fins is not feasible. In traditionally low cost countries, such features may be omitted or aftertreatment may be omitted altogether when emissions standards are less stringent. However, there is now an increased awareness of the effects of emissions in even low cost countries, so that a more easily manufactured and low cost method and apparatus for providing aftertreatment of exhaust gases is becoming necessary. More specifically, the emissions standards in such low cost countries are becoming more stringent, making the provision of low cost aftertreatment necessary.

Third, the space taken up by aftertreatment devices may be greater than desired in some applications. Reducing the space taken up by aftertreatment devices may allow for improvements or additions to other systems such as the engine, etc. So, reducing the size of the aftertreatment device such as a CAN assembly may be useful.

U.S. Pat. No. 6,312,650 to Frederiksen et al illustrates a silencer or CAN assembly that is used to clean exhaust gases. The CAN assembly comprises an air-tight casing (1) connected to an exhaust inlet pipe (2) and to an exhaust outlet pipe (3) and contains at least two acoustic compartments (4 i , 4 ii) and one or more monolithic bodies (5) such as catalyzers or particle filters through which exhaust gases flow in a flow direction in longitudinal channels or porosities, and one or more pipes or channels (6, 7), at least one pipe or channel penetrating one or more of the monolithic bodies (5) and guiding exhaust gases in a flow direction which is opposite to the flow direction in the channels or porosities of the monolithic body (5), and at least one of the pipes or channels (6, 7) connecting the at least two acoustic compartments (4 i , 4 ii). The general flow direction is preferably reversed substantially immediately upstream of a penetrated monolithic body (5) and substantially immediately downstream of either the same monolithic body (5) or of another penetrated monolithic body. Solid particles active for catalytic reduction of NOx, or a spray of a liquid containing an aqueous solution of urea and/or ammonia, active for catalytic reduction of NOx, may be injected into the exhaust gases to impinge on a catalytic layer (35, 36) applied on a baffle (13), an end cap (11, 12) or a flow element being arranged so that said particles and/or droplets impinge thereon.

As can be seen, the design of Frederiksen et al does not address some of the current market demands such as having a reduced size and complexity while still ensuring sufficient DEF is mixed sufficiently into the exhaust gas stream produced by a diesel engine or the like. Accordingly, it is desirable to develop an aftertreatment device that has a reduced size and complexity while sufficiently mixing DEF or other exhaust gas treatment fluid into the stream of exhaust gas than has been yet devised.

SUMMARY OF THE DISCLOSURE

A canister assembly for use in an exhaust gas aftertreatment device according to an embodiment of the present disclosure comprises a cylindrical shell defining a cylindrical axis, a radial direction, and a circumferential direction, a top end, a bottom end and an interior between the top end and the bottom end. A flow tube is inserted into the top end of the cylindrical shell and terminates short of the bottom end of the cylindrical shell, defining an exit of the flow tube. A mixing bowl member including a symmetrical annular shape about the cylindrical axis and defining a mixing bowl pocket being in fluid communication with the interior of the cylindrical shell and that is fixedly attached at the bottom end of the cylindrical shell and the exit of the flow tube is positioned radially above the mixing bowl pocket and spaced axially away from the mixing bowl member.

A canister subassembly according to an embodiment of the present disclosure comprises a cylindrical shell defining a cylindrical axis, a radial direction, and a circumferential direction, a top end, a bottom end, and an interior between the top end and the bottom end. A mixing bowl member is also provided that includes a symmetrical annular shape about the cylindrical axis and that defines a mixing bowl pocket with a flow divider facing toward the interior of the cylindrical shell, the mixing bowl member being fixedly attached at the bottom end of the cylindrical shell and the flow divider is radially centered.

A mixing bowl member according to an embodiment of the present disclosure comprises a generally cylindrical body defining a radial direction, an axial direction, and a circumferential direction, and includes a top axial surface, a bottom axial surface, and an outer cylindrical surface. The top axial surface defines a mixing bowl pocket including a flow divider that is radially centered.

DETAILED DESCRIPTION

Figure 1:
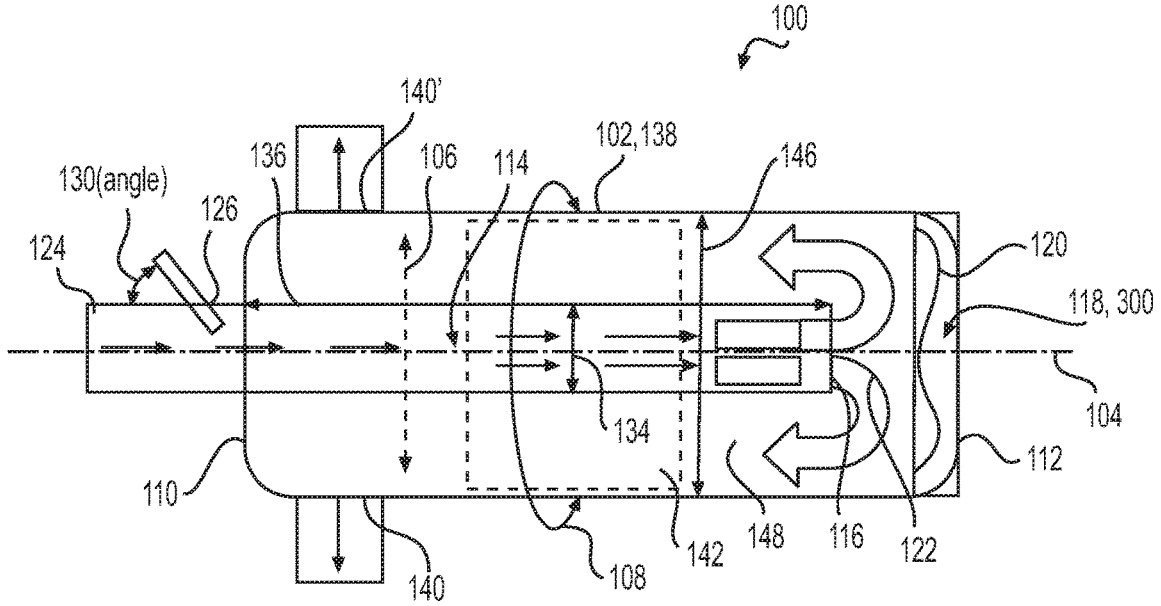
FIG. 1 is a schematic view of a canister (CAN) assembly with a mixing bowl at the bottom of the assembly according to an embodiment of the present disclosure showing the injection of diesel exhaust fluid into a stream of diesel exhaust gas near the top of the CAN assembly.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or a prime indicator such as 100', 100" etc. It is to be understood that the use of letters or primes immediately after a reference number indicates that these features are similarly shaped and have similar function as is often the case when geometry is mirrored about a plane of symmetry. For ease of explanation in this specification, letters or primes will often not be included herein but may be shown in the drawings to indicate duplications of features discussed within this written specification.

Various embodiments of a canister assembly or a canister subassembly for use with an exhaust gas aftertreatment device or other chemical process and an associated mixing bowl member will now be described according to the present disclosure. While many embodiments deal with the use of DEF with diesel exhaust gases, other embodiments may involve the exhaust associated with the use of a natural gas blend or a methane gas blend as a fuel, etc.

Looking at FIGS. 1 and 2, a canister assembly for use in an exhaust gas aftertreatment device will now be discussed. The canister assembly 100 may comprise a cylindrical shell 102 defining a cylindrical axis 104, a radial direction 106, and a circumferential direction 108, a top end 110 and a bottom end 112. A flow tube 114 may be inserted into the top end 110 of the cylindrical shell 102 and terminate short of the bottom end 112 of the cylindrical shell 102, defining an exit 116 of the flow tube 114. In many embodiments, the flow tube 114 has a cylindrical annular shape, similar to that of the cylindrical shell 102, and may be concentric therewith. A mixing bowl member 118 may be provided that includes a symmetrical annular shape about the cylindrical axis 104 and that defines a mixing bowl pocket 120. The mixing bowl member 118 is attached at the bottom end 112 of the cylindrical shell 102 and the exit 116 of the flow tube 114 is positioned radially above the mixing bowl pocket 120 and spaced axially away from the mixing bowl member 118, creating a radial flow path 122 between mixing bowl member 118 and the flow tube 114.

As a result of this arrangement, an exhaust gas and exhaust gas treatment fluid mixture may flow through the flow tube 114 and impinge on the mixing bowl pocket 120, improving the mixing or diffusing of the exhaust gas treatment fluid such as DEF with the exhaust gas. In the embodiments specifically shown in FIGS. 1 and 2, the flow tube 114 defines an inlet 124 that is disposed axially outside the top end 110 of the cylindrical shell 102 and an exhaust gas treatment liquid injection point 126 is disposed proximate the top end 110 of the cylindrical shell 102. In some embodiments, such as depicted in FIG. 2, a charge air injection point 128 is provided that is disposed axially outside the top end 110 of the cylindrical shell 102 radially opposite of the exhaust gas treatment liquid injection point 126. This may aid the initial mixing of the exhaust gas treatment liquid into the exhaust gas so that the exhaust gas treatment liquid is less likely to condense in the flow tube 114 before reaching the mixing bowl member 118.

Anything that improves turbulence or flow rate may improve the initial mixing of the exhaust gas treatment liquid in the exhaust gas stream so that fins, flappers and other devices are not needed in the flow tube 114, reducing the cost and complexity of the canister assembly 100. To that end, various variables may be optimized to achieve the desired result including the angle 130 of injection of the exhaust gas treatment liquid, the angle 132 of injection of the charge air, the diameter 134 of the flow tube 114, the effective axial length 136 of the flow tube 114, etc. In some embodiments, diameter 134 of the flow tube 114 may range from one to three inches and the length 136 of the flow tube 114 from the injection point 126 may range from nine to twenty-seven inches. The angle 130 of injection of the exhaust gas treatment liquid forms with the axial direction 104 may be 20 to 80 degrees, and may be approximately 30 to 60 degrees in some embodiments. The angle 132 of injection of the charge air may have similar ranges and be measured in like fashion. Droplet size of the exhaust gas treatment liquid may also be optimized to improve the initial mixing. Smaller droplets may naturally mix better.

Any dimensions, angles or ratios discussed herein may be varied as needed or desired depending on the application. The diameter of the flow tube may be 5 inches, six inches or greater is some embodiments (e.g. marine applications using large engines such as those having a capacity of 27/32 liters). The length of the flow tube may be as long as the total aftertreatment package needs to be (based on performance and packaging constraints). The angle of injection (for both DEF and charge air) may also be modified to be any angle as it pertains to performance/packaging requirements.

The mixing process may have two phases. The first initial mixing phase may take place in the flow tube and needs only to be sufficient to avoid condensation. The second mixing phase takes place as the flow impinges on the pocket of the mixing bowl member, maximizing the effectiveness of the reduction of emissions.

Figure 2:
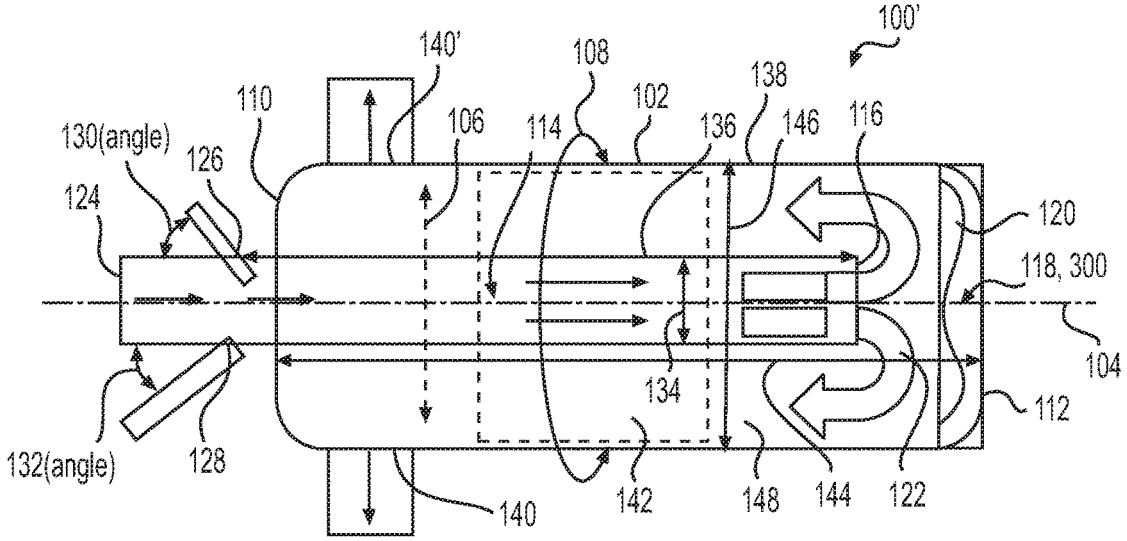
FIG. 2 is a schematic view of a canister (CAN) assembly similar to that of FIG. 1, showing the injection of charged air opposite of the injection of diesel exhaust fluid near the top of the CAN assembly.

As shown in FIGS. 1 and 2, the cylindrical shell 102 defines a circumferential surface 138 and an outlet 140 disposed along the circumferential surface 138 of the cylindrical shell 102. Two diametrically opposite outlets 140, 140' may be provided. In addition, the canister assembly 100 may further comprise at least one annular shaped aftertreatment device 142 disposed in the cylindrical shell 102 about the flow tube 114. The at least one annular shaped aftertreatment device 142 may include one of the following: diesel oxidation catalyst (DOC), diesel particulate filter (DPF), selective catalytic reduction (SCR), and ammonia oxidation catalyst (AMOx).

In still further embodiments, the cylindrical shell 102 may also have a length range greater than 27 inches and a diameter greater than 9 inches. For example, the diameter may be approximately 14 inches in some embodiments.

Again, any of the dimensions, angles, or ratios as discussed herein may be modified as needed or desired in other applications.

As a result of all these various features, the canister assembly 100 may take up less space, be less complex lacking fins and flappers, and less costly than other previously known canister assemblies or other similar exhaust gas aftertreatment devices. The desirable outside dimensions of the canister assembly 100 may be expressed as follows. The cylindrical shell 102 may define an axial length 144 ranging from 9 inches to 27 inches and a diameter 146 ranging from 3 inches to 9 inches in some embodiments. An associated aspect ratio of the length 144 to diameter 146 may range from 3:1 to 9:1.

The functioning of the canister assembly 100 of FIGS. 1 and 2 may be described as follows. Exhaust gas enters the inlet 124 of the flow tube 114 and flows axially until it reaches the exhaust gas treatment liquid injection point 126 and a charge air injection point 128 (if provided). Then, the exhaust gas treatment liquid such as DEF is injected into the exhaust gas, initially mixing therewith. Optionally, the charge air may be also injected to create turbulence, enhancing this mixing. These injection points 126, 128 may be located outside of the cylindrical shell 102 in the flow tube 114 as shown in FIGS. 1 and 2 or inside cylindrical shell in the flow tube in other embodiments. The initially mixed exhaust gas and exhaust gas treatment liquid then proceeds axially down the flow tube 114 out the exit 116 and impinges on the mixing bowl member 118 for a more complete mixing as previously described.

More particularly, the mixture enters the mixing bowl pocket 120 of the mixing bowl member 118, improving the diffusing or mixing of the exhaust gas treatment liquid into the exhaust gas. The mixture is then redirected by the mixing bowl pocket 120 down the annular pathway 148 defined between the flow tube 114 and the cylindrical shell 102 until it reaches auxiliary aftertreatment devices 142 (if provided) to further enhance cleaning or other treatment of the exhaust gas. Once the exhaust gas has been fully treated, it then exits out the outlet and eventually passes to the atmosphere.

Figure 3:
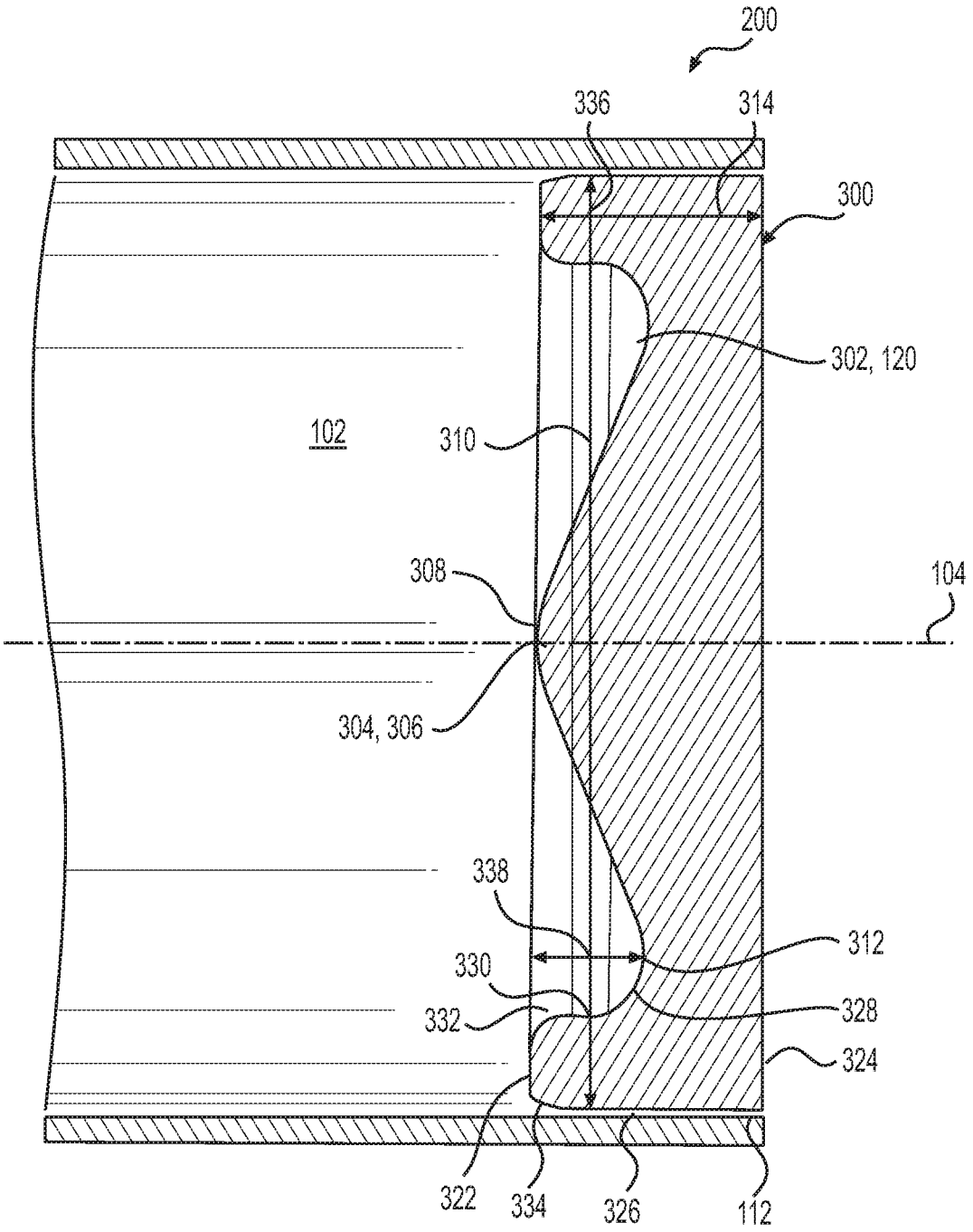
FIG. 3 is an enlarged side sectional view of the mixing bowl disposed at the bottom of the CAN assemblies of FIGS. 1 and 2, showing the mixing bowl geometry of a mixing bowl member attached to the shell of the CAN assembly more clearly.

Referring now to FIG. 3, a canister subassembly 200 may comprise a cylindrical shell 102 defining a cylindrical axis 104, a radial direction 106, and a circumferential direction 108, a top end 110 (see FIGS. 1 and 2) and a bottom end 112. A mixing bowl member 118, 300 may also be provided that includes a symmetrical annular shape about the cylindrical axis 104 and that defines a mixing bowl pocket 120, 302 and includes a flow divider 304. The mixing bowl member 300 may be attached at the bottom end 112 of the cylindrical shell 102 and the flow divider 304 may be radially centered with respect to the cylindrical shell 102.

For the embodiment shown in FIG. 3, the flow divider 304 is a projection 306 but it is contemplated that the flow divider 304 may be an indentation in other embodiments. The projection 306 may include a peak 308 and a conical surface 310 that slopes away from the peak 308, terminating proximate the axial bottom extremity 312 of the mixing bowl pocket 302. As a result of this configuration of the flow divider 304, any fluid such as a mixture of exhaust gas and exhaust gas treatment liquid may be split by the peak 308 of the projection 306, which sends the split flow of the mixture down along the conical surface 310 to the swirl pocket where mixing is enhanced.

As shown in FIG. 3, the mixing bowl member 300 includes a generally cylindrical shape that is inserted into the bottom end 112 of the cylindrical shell 102. The mixing bowl member 300 may be welded onto the cylindrical shell 102. Plug welds or seam welds are possible. The cylindrical shell 102 may define a first axial length 144 (see FIG. 1 or 2) and the mixing bowl member 300 may define a second axial length 314, and the ratio of the first axial length 144 to the second axial length 314 may range from 8:1 to 20:1. The cylindrical shell or flow tube may comprise a stainless steel or any other suitably durable and corrosion resistant material (e.g. titanium).

As used herein, "arcuate" includes any shape that is not straight including radial, elliptical, polynomial, etc. The term "blend" may also be similarly understood.

Figure 4:
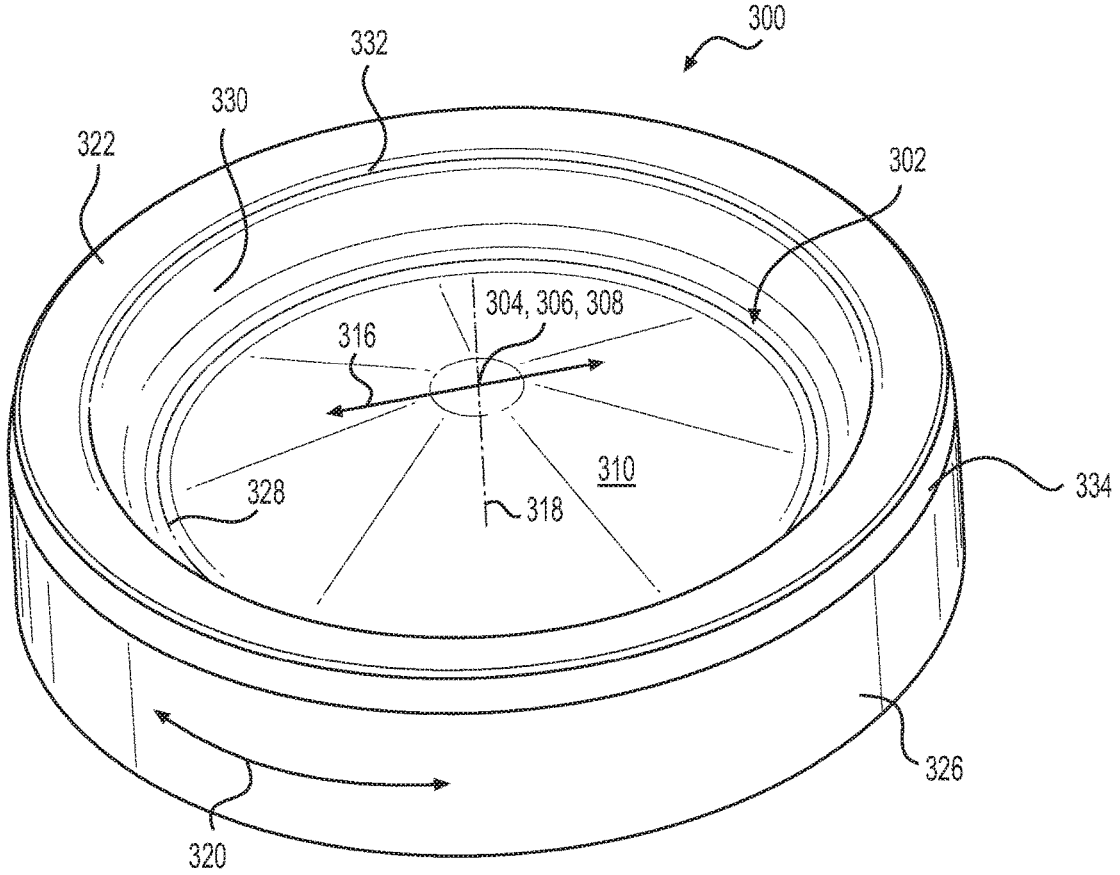
FIG. 4 is a perspective view of the mixing bowl member of FIG. 3 removed from the CAN assembly.
Figure 5:
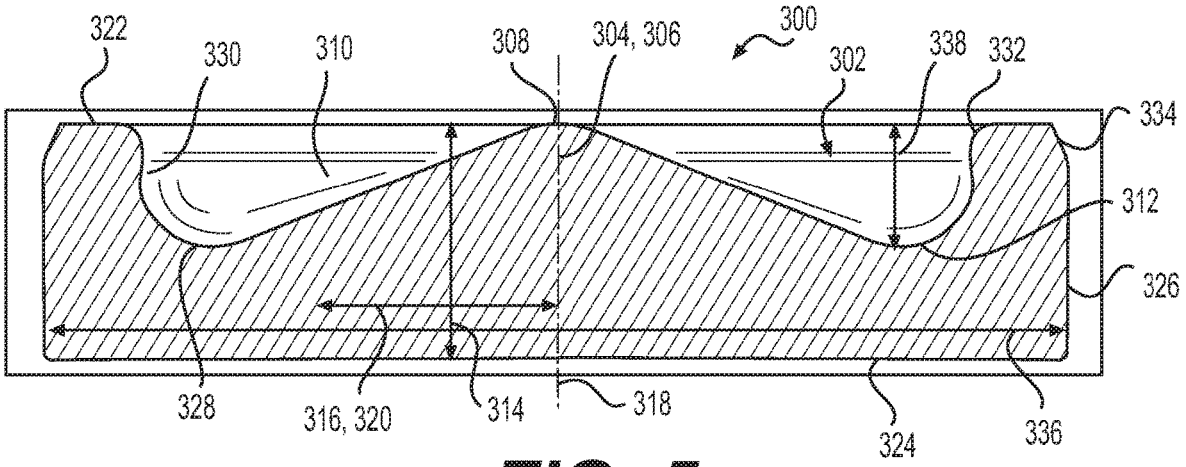
FIG. 5 is a side sectional view of the mixing bowl member of FIG. 4.

Focusing now on FIGS. 4 and 5, a mixing bowl member 300 may be provided for use with a canister assembly 100 or a canister subassembly 200 for any purpose mentioned herein. The mixing bowl member 300 may comprise a generally cylindrical body defining a radial direction 316, an axial direction 318, and circumferential direction 320. The body may also have a top axial surface 322, a bottom axial surface 324, and an outer cylindrical surface 326. The top axial surface 322 defines a mixing bowl pocket 302 including a flow divider 304 that is radially centered. The flow divider 304 may take any suitable form including an indentation or a projection 306.

As shown in FIGS. 3 thru 5, the flow divider 304 is a projection 306 including a peak 308 terminating axially even with the top axial surface 322. This may not be the case in other embodiments. For example, the projection may extend axially past the top axial surface so that the projection is closer to a flow tube to provide a more gradual splitting of the flow. The projection 306 may include a sloping conical surface 310 that terminates axially proximate the bottom axial extremity 312 of the mixing bowl pocket 302. The body may further define a bottom arcuate surface 328 defining the bottom axial extremity 312 of the mixing bowl pocket 302 and an inside cylindrical surface 330 leading from the bottom arcuate surface 328 toward the top axial surface 322. A top arcuate blend 332 may transition from the inside cylindrical surface 330 to the top axial surface 322, and a lead-in surface 334 (such as a chamfer) may connect or extend from the top axial surface 322 to the outer cylindrical surface 326. This lead-in surface 334 may facilitate the insertion of the mixing bowl member into a shell.

The outer cylindrical surface 326 may define a diameter 336 and the body may define an axial length 314 measured from the top axial surface 322 to the bottom axial surface 324. The ratio of the axial length 314 to the diameter 336 may range from 3:1 to 8:1. Also, the axial depth 338 of the pocket 302 measured from the top axial surface 322 to the bottom axial extremity 312 of the mixing bowl pocket 302 may be approximately 40% to 60% of the axial length 314 of the body. This configuration may aid in minimizing the size of the canister assembly or canister subassembly while also promoting mixing and redirecting flow toward the annular flow path found between the flow tube and the shell.

The body of the mixing bowl member 300 may comprise a stainless steel or any other suitably durable and corrosion resistant material. For example, a 316 stainless steel, a 400 stainless steel, 420 stainless steel, 439 stainless steel, 440 stainless steel, 441 stainless steel, etc. may be used. Titanium may also be used but could be cost prohibitive. The body may be made from steel plate and then machined using turning, milling, and/or electrical discharge machining processes. Or, the body could be cast and then machined. Other methods of manufacturing the mixing bowl member are contemplated to be within the scope of the present disclosure.

Industrial Applicability

In practice, a mixing bowl member, a canister subassembly, and/or a canister assembly according to any embodiment described herein may be provided, sold, manufactured, and bought etc. as needed or desired in an aftermarket or OEM (Original Equipment Manufacturer) context. For example, a mixing bowl member, a canister subassembly, or a canister assembly may be used to retrofit an existing exhaust system for an engine already in the field or may be sold with an engine/exhaust system or a piece of equipment using that engine or exhaust system at the first point of sale of the piece of equipment.

Other chemical mixing applications may also benefit from the use of various embodiments of the mixing bowl member, canister subassembly, and/or a canister assembly as alluded to earlier herein in either an aftermarket or OEM context.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A canister assembly for use in an exhaust gas aftertreatment device, the canister assembly comprising:

a cylindrical shell defining a cylindrical axis, a radial direction, and a circumferential direction, a top end, a bottom end and an interior between the top end and the bottom end;

a flow tube inserted into the top end of the cylindrical shell and terminating short of the bottom end of the cylindrical shell, defining an exit of the flow tube; and a mixing bowl member including a generally symmetrical annular shape about the cylindrical axis and defining a mixing bowl pocket being in fluid communication with the interior of the cylindrical shell, the mixing bowl member being fixedly attached at the bottom end of the cylindrical shell and the exit of the flow tube is positioned radially above the mixing bowl pocket and spaced axially away from the mixing bowl member;

wherein an exhaust gas treatment liquid injection point is disposed proximate the top end of the cylindrical shell and includes an outlet to inject exhaust gas treatment liquid into the flow tube to define a first mixing phase of exhaust gas and the exhaust gas treatment liquid, and the mixing bowl defines a second mixing phase of exhaust gas and the exhaust gas treatment liquid, the second mixing phase being disposed downstream of the first mixing phase.

2. The canister assembly of claim 1, wherein the flow tube defines an inlet that is disposed axially outside the top end of the cylindrical shell.

3. The canister assembly of claim 2, further comprising a charge air injection point that is disposed axially outside the top end of the cylindrical shell radially opposite of the exhaust gas treatment liquid injection point.

4. The canister assembly of claim 1, wherein the cylindrical shell defines a circumferential surface and an outlet point along the circumferential surface of the cylindrical shell.

5. The canister assembly of claim 4, further comprising at least one annular shaped aftertreatment device disposed in the cylindrical shell about the flow tube.

6. The canister assembly of claim 5, wherein the at least one annular shaped aftertreatment device includes one of the following: diesel oxidation catalyst, diesel particulate filter, selective catalytic reduction, and ammonia oxidation catalyst.

7. The canister assembly of claim 1, wherein the cylindrical shell defines an axial length ranging from 9 inches to 27 inches and a diameter ranging from 3 inches to 9 inches.

8. A canister subassembly for use in an exhaust gas aftertreatment device, the canister subassembly comprising:

a cylindrical shell defining a cylindrical axis, a radial direction, and a circumferential direction, a top end, a bottom end and an interior between the top end and the bottom end; and a mixing bowl member including a generally symmetrical annular shape about the cylindrical axis and defining a mixing bowl pocket and including a flow divider facing towards the interior of the cylindrical shell, the mixing bowl member being fixedly attached at the bottom end of the cylindrical shell and the flow divider is radially centered;

wherein the flow divider is a projection that includes a peak and a conical surface that slopes away from the peak and the mixing bowl pocket defines an axial bottom extremity, and the conical surface terminates proximate the axial bottom extremity of the mixing bowl pocket, and the mixing bowl member includes a generally cylindrical shape that is inserted into the bottom end of the cylindrical shell.

9. The canister subassembly of claim 8, the mixing bowl member is welded onto the cylindrical shell.

10. The canister subassembly of claim 8, wherein the cylindrical shell defines a first axial length and the mixing bowl member defines a second axial length, and a ratio of the first axial length to the second axial length ranges from 8:1 to 20:1.

11. The canister subassembly of claim 8, wherein the mixing bowl member further defines a bottom arcuate surface defining the bottom axial extremity of the mixing bowl pocket.

12. The canister subassembly of claim 11, wherein the mixing bowl member further defines an inside cylindrical surface leading from the bottom arcuate surface toward the top axial surface, a top arcuate blend transitioning from the inside cylindrical surface to the top axial surface, and a lead-in surface connecting the top axial surface to the outer cylindrical surface.

13. The canister subassembly of claim 8, wherein the outer cylindrical surface defines a diameter and the mixing bowl member defines an axial length measured from the top axial surface to the bottom axial surface, and a ratio of the axial length to the diameter ranges from 3:1 to 8:1.

14. The canister subassembly of claim 8, wherein the mixing bowl member comprises a stainless steel.

15. A canister assembly for use in an exhaust gas aftertreatment device, the canister assembly comprising:

a cylindrical shell defining a cylindrical axis, a radial direction, and a circumferential direction, a top end, a bottom end and an interior between the top end and the bottom end;

a flow tube inserted into the top end of the cylindrical shell and terminating short of the bottom end of the cylindrical shell, defining an exit of the flow tube; and a mixing bowl member including an annular shape about the cylindrical axis and defining a mixing bowl pocket being in fluid communication with the interior of the cylindrical shell, the mixing bowl member being fixedly attached at the bottom end of the cylindrical shell and the exit of the flow tube is positioned radially above the mixing bowl pocket and spaced axially away from the mixing bowl member;

wherein an exhaust gas treatment liquid injection point is disposed proximate the top end of the cylindrical shell and includes an outlet to inject exhaust gas treatment liquid into the flow tube to define a first mixing phase of exhaust gas and the exhaust gas treatment liquid, and the mixing bowl defines a second mixing phase of exhaust gas and the exhaust gas treatment liquid, the second mixing phase being disposed downstream of the first mixing phase.

16. The canister assembly of claim 15, wherein the flow tube defines an inlet that is disposed axially outside the top end of the cylindrical shell.

17. The canister assembly of claim 16, further comprising a charge air injection point that is disposed axially outside the top end of the cylindrical shell radially opposite of the exhaust gas treatment liquid injection point.

18. The canister assembly of claim 15, wherein the cylindrical shell defines a circumferential surface and an outlet point along the circumferential surface of the cylindrical shell.

19. The canister assembly of claim 18, further comprising at least one annular shaped aftertreatment device disposed in the cylindrical shell about the flow tube.

20. The canister assembly of claim 19, wherein the at least one annular shaped aftertreatment device includes one of the following: diesel oxidation catalyst, diesel particulate filter, selective catalytic reduction, and ammonia oxidation catalyst and the cylindrical shell defines an axial length ranging from 9 inches to 27 inches and a diameter ranging from 3 inches to 9 inches.

* * * * *